US011612789B2

(12) United States Patent
Cyrulik et al.

(10) Patent No.: US 11,612,789 B2
(45) Date of Patent: Mar. 28, 2023

(54) GOLF CLUB HEAD WITH SOLE RAILS

(71) Applicant: SUMITOMO RUBBER INDUSTRIES, LTD., Kobe (JP)

(72) Inventors: Darius Cyrulik, Huntington Beach, CA (US); Anthony Munson, Huntington Beach, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 16/502,631

(22) Filed: Jul. 3, 2019

(65) Prior Publication Data

US 2021/0001186 A1 Jan. 7, 2021

(51) Int. Cl.
*A63B 53/04* (2015.01)
*A63B 60/52* (2015.01)

(52) U.S. Cl.
CPC ..... *A63B 53/04* (2013.01); *A63B 60/52* (2015.10); *A63B 53/0433* (2020.08)

(58) Field of Classification Search
CPC . A63B 53/04; A63B 60/52; A63B 2053/0433; A63B 53/0466; A63B 53/0433; A63B 53/0408
USPC ..... 473/324
See application file for complete search history.

(56) References Cited

U.S. PATENT DOCUMENTS 3,985,363 A * 10/1976 Jepson ..... A63B 53/04 473/309
4,332,388 A * 6/1982 Crow ..... A63B 53/04 473/328
5,398,935 A * 3/1995 Katayama ..... A63B 53/0466 473/324
D361,356 S * 8/1995 Feche ..... D21/752
D362,039 S * 9/1995 Lin ..... D21/752
5,497,995 A * 3/1996 Swisshelm ..... A63B 53/04 473/350
5,611,741 A 3/1997 Schmidt et al.
D410,057 S * 5/1999 Ortiz ..... D21/752
5,967,902 A 10/1999 Greenquist et al.
6,007,433 A 12/1999 Helmstetter et al.
6,027,416 A 2/2000 Schmidt et al.
6,146,287 A 11/2000 Rugge et al.
D435,075 S * 12/2000 Ota ..... D21/759
RE37,647 E 4/2002 Wolf
D457,583 S * 5/2002 Olsavsky ..... D21/752
6,663,503 B1 * 12/2003 Kenmi ..... A63B 53/04 473/328
7,273,419 B2 9/2007 Evans et al.
7,824,277 B2 11/2010 Bennett et al.
8,021,247 B2 9/2011 Brolly
(Continued)

*Primary Examiner* — Michael D Dennis
(74) *Attorney, Agent, or Firm* — Oliff PLC

(57) ABSTRACT

A golf club head, when oriented in a reference position, includes: a striking face; a top portion; and a sole portion opposite the top portion. The sole portion includes a leading edge, a trailing edge, at least one sole rail generally elongate in a front-to-rear direction, and a sole contact point located on the at least one sole rail. In a virtual vertical plane extending in the front-to-rear direction and passing through the sole contact point, (i) the sole portion includes a sole length Ls measured in the front-to-rear direction from the leading edge to the trailing edge and (ii) the sole contact point is spaced rearwardly from the leading edge by a distance D1 no greater than 0.8*Ls.

16 Claims, 8 Drawing Sheets

(56) References Cited

U.S. PATENT DOCUMENTS

| | | | | |
|---|---|---|---|---|
| 8,328,658 | B2 | 12/2012 | Bennett et al. | |
| 8,690,706 | B2 | 4/2014 | Stites et al. | |
| 8,771,097 | B2 | 7/2014 | Bennett et al. | |
| 10,143,900 | B2 | 12/2018 | Harrington et al. | |
| 2011/0077101 | A1* | 3/2011 | Bennett | A63B 53/02 473/328 |
| 2013/0072319 | A1* | 3/2013 | Dolezel | A63B 53/047 473/290 |
| 2014/0235368 | A1* | 8/2014 | Burnett | A63B 53/0466 473/327 |
| 2017/0043222 | A1* | 2/2017 | Stokke | A63B 53/0466 |
| 2020/0001146 | A1* | 1/2020 | Morales | A63B 53/0466 |

* cited by examiner

EXEMPLARY EMBODIMENT

COMPARATIVE CLUB HEAD

GOLF CLUB HEAD WITH SOLE RAILS

BACKGROUND

This disclosure relates generally to the field of golf clubs. More particularly, it relates to a golf club head with at least one sole rail.

Many factors can influence the effectiveness of a golf shot. One of the most important of these factors is the speed at which the club head strikes the golf ball. This club head speed at impact not only substantially dictates how far the golf shot will travel, but its predictability and repeatability are of utmost importance for a golfer to hit a shot at a desired distance. Another factor influencing the effectiveness of the golf shot is the trajectory at which the golf ball leaves the club face following impact. This trajectory has a substantial impact on the ball's distance of travel, ability to clear hazards, and movement once having returned to the ground surface.

SUMMARY

One of the largest influences on the speed at which the club head strikes the golf ball is the effort exerted by the golfer, i.e., how hard the golfer swings. Large influences on the trajectory of the golf ball are the loft angle of the club head itself as well as the angle at which the club head attacks the ball during the swing. But interaction between the club head and the turf can also result in an unanticipated loss of club head speed prior to impact with the golf ball, and it can also result in de-lofting, i.e., flattening, of the club head prior to impact. This may lead to the aforementioned changes in and adverse declines in predictability of shot distance and golf ball trajectory following impact. This is especially true with respect to hybrid or utility-type golf club heads, which are often employed in adverse turf conditions such as the rough, which may offer more resistance to the club head and thereby substantially reduce speed retention, and which club types are generally relied on for longer golf shots than say irons and wedges.

A golf club head has thus been sought that improves club head speed retention throughout the swing and prevents loss of this speed due to turf interaction. This goal may be achieved by one or more aspects of the present disclosure, in which the sole contour of the club head, e.g., its width and leading edge shape, may be designed for this specific purpose by way of optimization through numerous iterations.

A golf club head according to one or more aspects of the present disclosure may thus, when oriented in a reference position, comprise: a striking face; a top portion; and a sole portion opposite the top portion. The sole portion may in turn comprise a leading edge, a trailing edge, at least one sole rail generally elongate in a front-to-rear direction, and a sole contact point located on the at least one sole rail. And in a virtual vertical plane extending in the front-to-rear direction and passing through the sole contact point, the sole portion may include a sole length Ls measured in the front-to-rear direction from the leading edge to the trailing edge, and the sole contact point may be spaced rearwardly from the leading edge by a distance D1 no greater than 0.8*Ls.

A golf club head in accordance with one or more aspects of the present disclosure may, when oriented in a reference position, also comprise: a striking face; a top portion; and a sole portion opposite the top portion. The sole portion may in turn comprise a leading edge, a trailing edge, a first sole rail generally elongate in a front-to-rear direction, a second sole rail generally elongate in the front-to-rear direction, and a recess formed between the first sole rail and the second sole rail. The recess may have a step-down portion defined in the front-to-rear direction.

And a golf club head in accordance with one or more aspects of the present disclosure may, when oriented in a reference position, yet further comprise: a striking face; a top portion; and a sole portion opposite the top portion. The sole portion may comprise a leading edge, a trailing edge, at least one sole rail generally elongate in a front-to-rear direction, and a sole contact point located on the at least one sole rail. And in a virtual vertical plane extending in the front-to-rear direction and passing through the sole contact point, the leading edge may include a height H1 of no less than 5 mm; the sole may further comprise a first radius of curvature R1 at a first location spaced rearward from the leading edge by no less than 3 mm and a second radius of curvature R2 at a second location rearward of the first location; and R2 may be no less than 10*R1.

These and other features and advantages of the golf club head according to the various aspects of the present disclosure will become more apparent upon consideration of the following description, drawings, and appended claims. The description and drawings described below are for illustrative purposes only and are not intended to limit the scope of the present invention in any manner. It is also to be understood that, for the purposes of this application, any disclosed range encompasses a disclosure of each and every sub-range thereof. For example, the range of 1-5 encompasses a disclosure of at least 1-2, 1-3, 1-4, 1-5, 2-3, 2-4, 2-5, 3-4, 3-5, and 4-5. Further, the end points of any disclosed range encompass a disclosure of those exact end points as well as of values at approximately or at about those endpoints.

BRIEF DESCRIPTION OF THE DRAWINGS

Exemplary embodiments of the present disclosure will now be described with reference to the accompanying drawings.

DETAILED DESCRIPTION OF EMBODIMENTS

Figure 1:
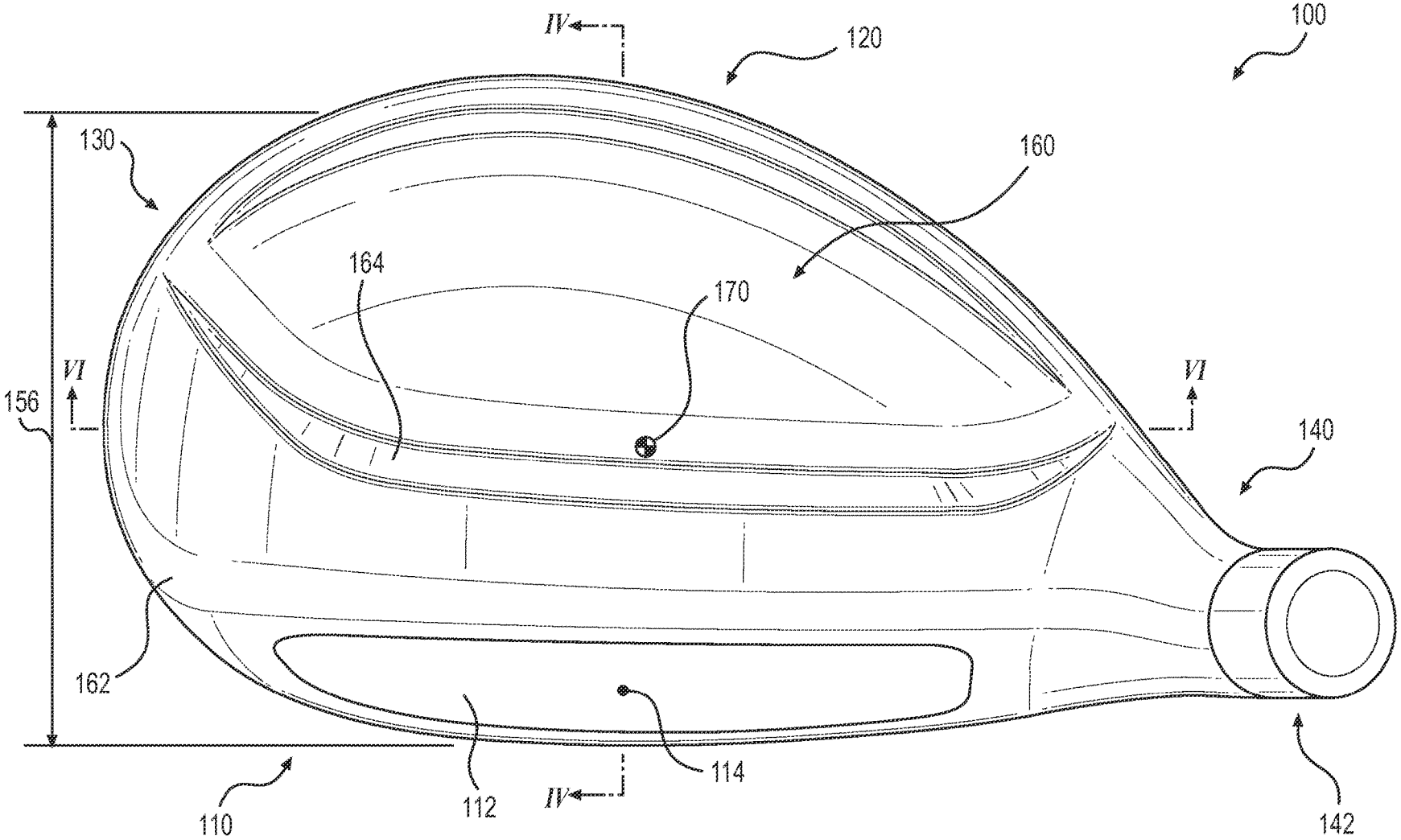
FIG. 1 shows a top plan view of a golf club head in accordance with one or more exemplary embodiments.

Shown in FIG. 1 is a golf club head 100 according to one or more aspects of the present disclosure. The club head 100 may be a hollow-type club head. For example, as shown in FIG. 1, it may be a hybrid or utility-type club head. The club head 100 may generally be formed from metallic and/or nonmetallic materials, such as any one or a combination of aluminum, stainless steel, titanium, composites, polymeric materials, and any other suitable material.

The club head 100 may include a front portion 110, which has a striking wall including a striking face 112 for contacting a golf ball, and a rear portion 120. The striking face 112 may include a face center 114, which is the point on the striking face 112 that is equidistant from the striking face periphery in both the horizontal direction and in the vertical direction, as set out in the United States Golf Association's Procedure for Measuring the Flexibility of a Golf Club Head (Revision 2.0, Mar. 25, 2005), in which "face center" is described as identifiable using a designated template for such purpose. The club head 100 may further include a toe portion 130, a heel portion 140, a sole portion 150, and a top portion, or crown, 160. The heel portion 140 may include a hosel 142 configured to receive and secure a shaft (not shown) of the golf club. And the club head 100 may include a club head center of gravity at the location 170.

The top portion 160 of the club head 100 may include a raised peripheral portion 162, which may provide additional structural integrity to the club head. This portion 162 may also increase, especially relative to prior club heads, the club head 100's moment of inertia ("MOI") about a vertical axis passing through the center of gravity 170, i.e., Izz. The top portion 160 may also include a step-down 164 that further lowers the center of gravity 170 and thus locates the sweet spot, which is a normal projection of the center of gravity 170 on the striking face 112, in a location more proximate the intended, e.g., average, impact point of the golf ball and the golf club head 100. A weight pad (not shown) may also be located on the interior of the sole portion 150 to yet further increase the MOI and reduce the height of the center of gravity for similar purposes. And being a utility-type club head, the loft angle, i.e., the angle formed between a virtual vertical hosel plane containing an axis of the hosel 142 and a striking face plane substantially parallel to the striking face 112, of the club head 100 may preferably be no greater than 26°. More preferably, this loft angle may be between 14° and 26°, and even more preferably between 18° and 24°. In embodiments where the striking face includes a bulge and/or roll, the virtual striking face plane may be considered to be a plane tangent to the face center of the striking face.

Figure 2:
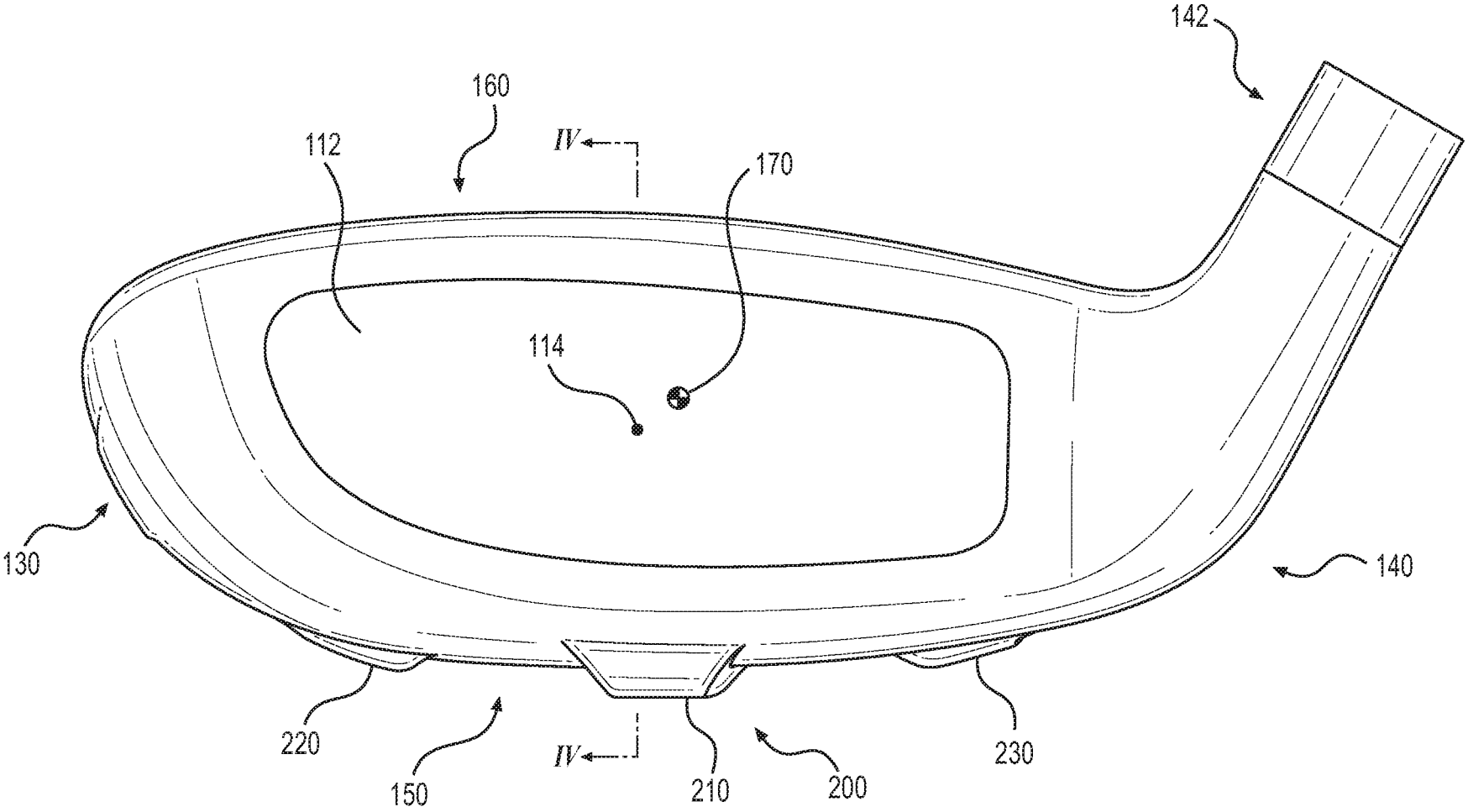
FIG. 2 shows a front side view of the golf club head of FIG. 1.
Figure 3:
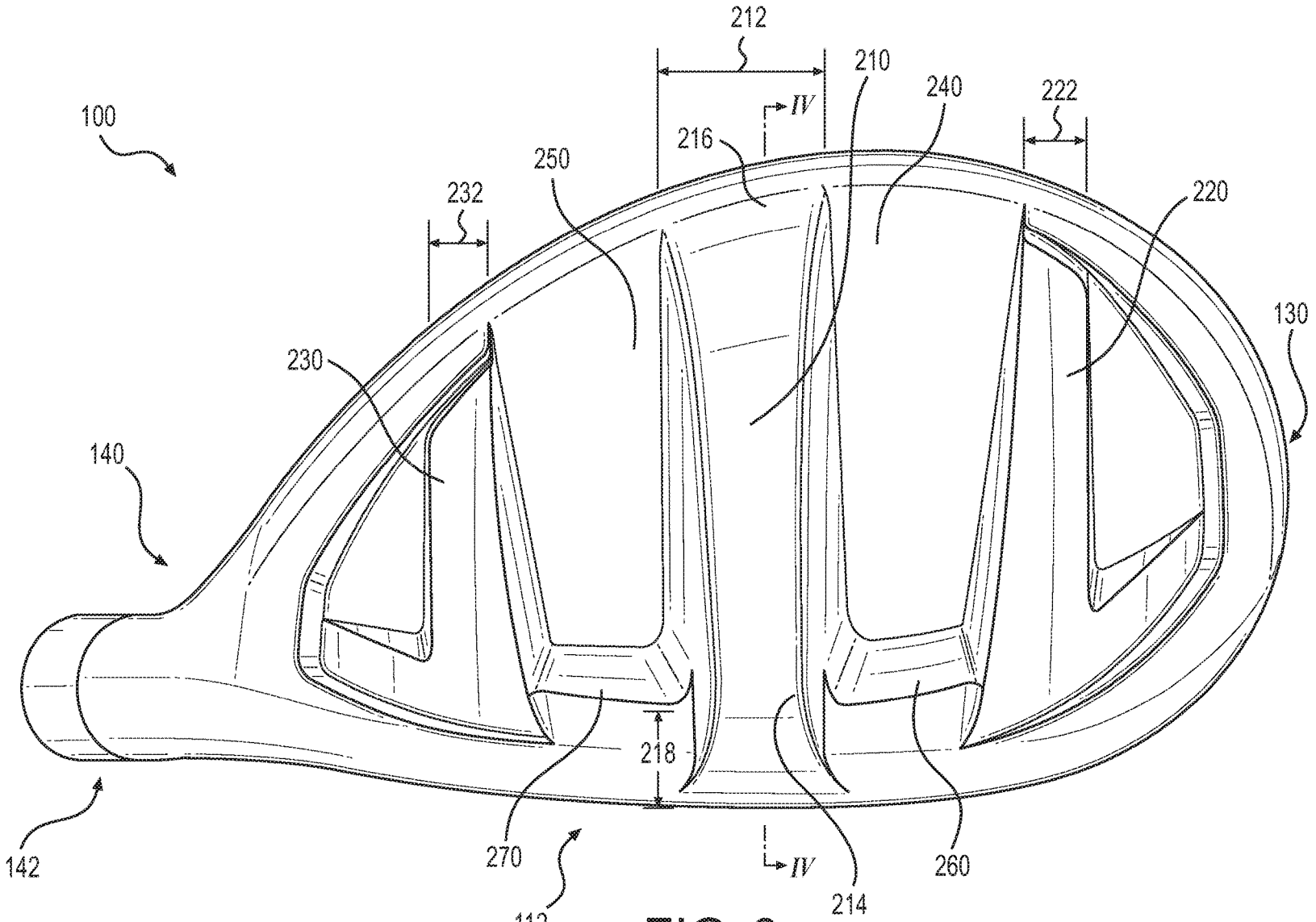
FIG. 3 shows a bottom plan view of the golf club head of FIG. 1.

As perhaps best shown in FIGS. 2 and 3, the sole portion 150 of the club head 100 may include a plurality of rails 200 that are each preferably elongate in the front-to-rear direction. More specifically, the club head 100 may include a central sole rail 210 laterally centered in the heel-to-toe direction with the face center 114, a toe-side sole rail 220, and a heel-side sole rail 230. A recess 240 in the sole portion 150 may space the central 210 and toe-side sole portions 220 from each other, and a recess 250 in the sole portion 150 may space the central 210 and heel-side sole portions 230 from each other. Each recess 240, 250 may include a bottom surface at least partially circumscribed by a side surface. The recesses 240 and 250 between the guide rails 210, 220, and 230 may channel debris therethrough during a swing, thereby reducing interaction and friction between the club head 100 and the turf and leading to improved speed retention. They may also cause the golfer to perceive the volume of the rails 210, 220, and 230 to be greater, thereby potentially increasing the golfer's confidence in the club head 100 and the shots to be made by it.

Figure 4:
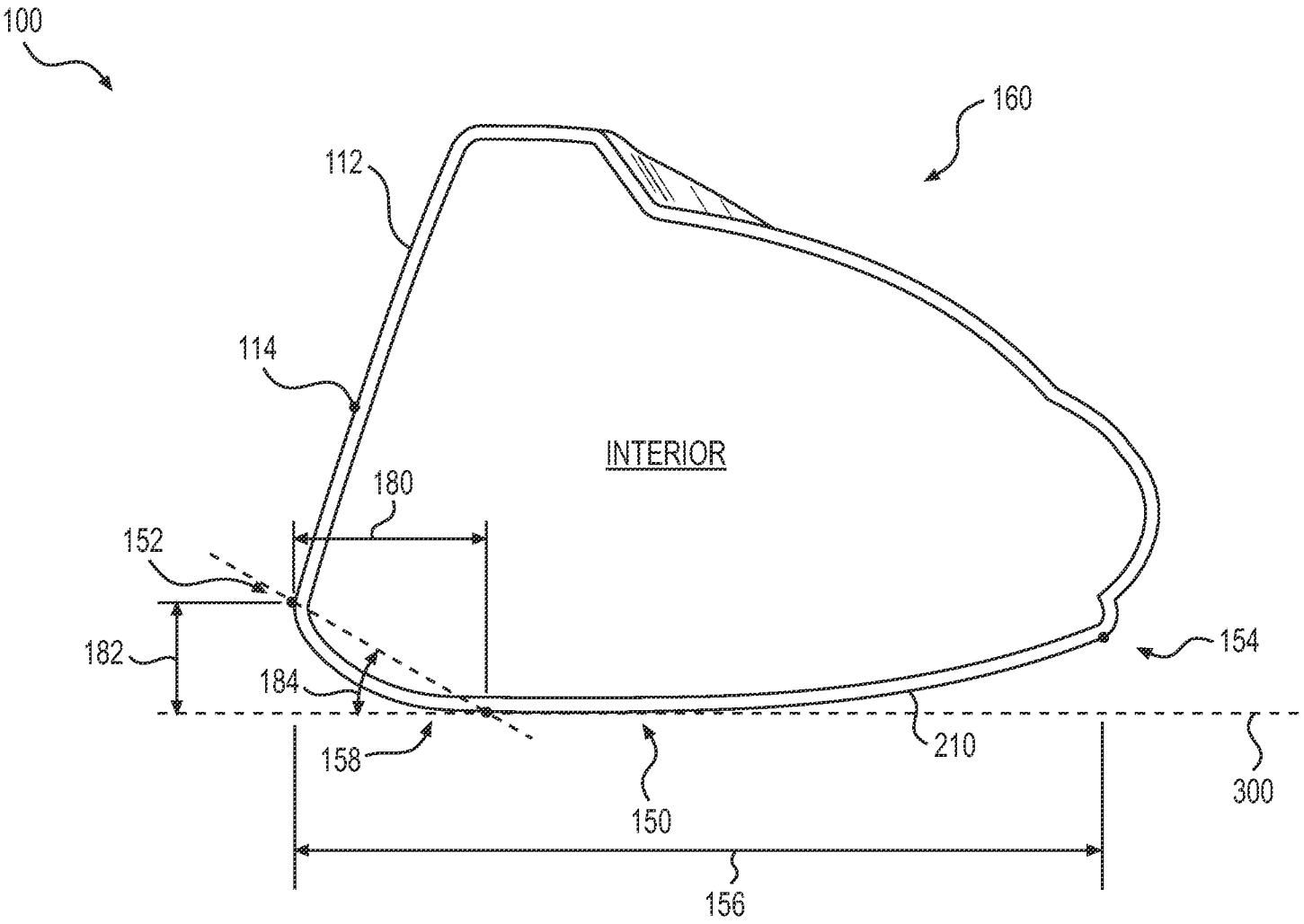
FIG. 4 shows a cross-section view of the golf club head of FIG. 1.

FIG. 4 shows a cross-section of the golf club head 100 taken along a virtual vertical plane IV that intersects the face center 114 and thus the central sole rail 210. As shown in this Figure, the sole portion 150 may include a leading edge 152 and a trailing edge 154, which respectively represent the forward-most and rearward-most extents of the sole portion 150. FIG. 4 shows the golf club head 100 in the reference position, which as used herein, refers to an orientation of a club head, e.g., the club head 100, relative to a virtual ground plane 300, in which the club head 100 is permitted to rest on the ground plane such that the sole portion 150 of the club head 100 contacts the ground plane at a sole contact point 158 between the edges 152 and 154, and a hosel axis of the hosel 142 is oriented such that the club head 100 is at its designated loft angle relative to the virtual ground plane 300 and the hosel axis lies at the club head's designated lie angle.

The edges 152 and 154 may define therebetween a sole length 156, which may otherwise be indicated by "Ls." The sole length 156 may preferably be no less than 35 mm, more preferably no less than 45 mm, and even more preferably, it may be between 45 mm and 65 mm. The setback length 180 of the sole contact point 158 from the leading edge 152 in the front-to-rear direction, otherwise referred to as "D1," may also be defined. For example, the setback length 180 may preferably be no greater than 0.8*Ls, more preferably no greater than 0.5*Ls, and even more preferably no greater than 0.25*Ls. In terms of absolute value, the setback length 180 may be between 5 mm and 15 mm and even more preferably between 8 mm and 12 mm. And as also shown in FIG. 4, the leading edge 152 may also define a height 182, or "H1," and a bounce angle 184. The height 182, which is the distance between the leading edge 152 and the virtual ground plane 300, may preferably be no less than 5 mm, more preferably no less than 6 mm, and even more preferably no less than 7 mm. And the bounce angle, which is the angle between the ground plane 300 and a virtual line extending through the leading edge 152 and the sole contact point 158 may be between 2° and 180 degrees, preferably between 100 and 18°.

Figure 5:
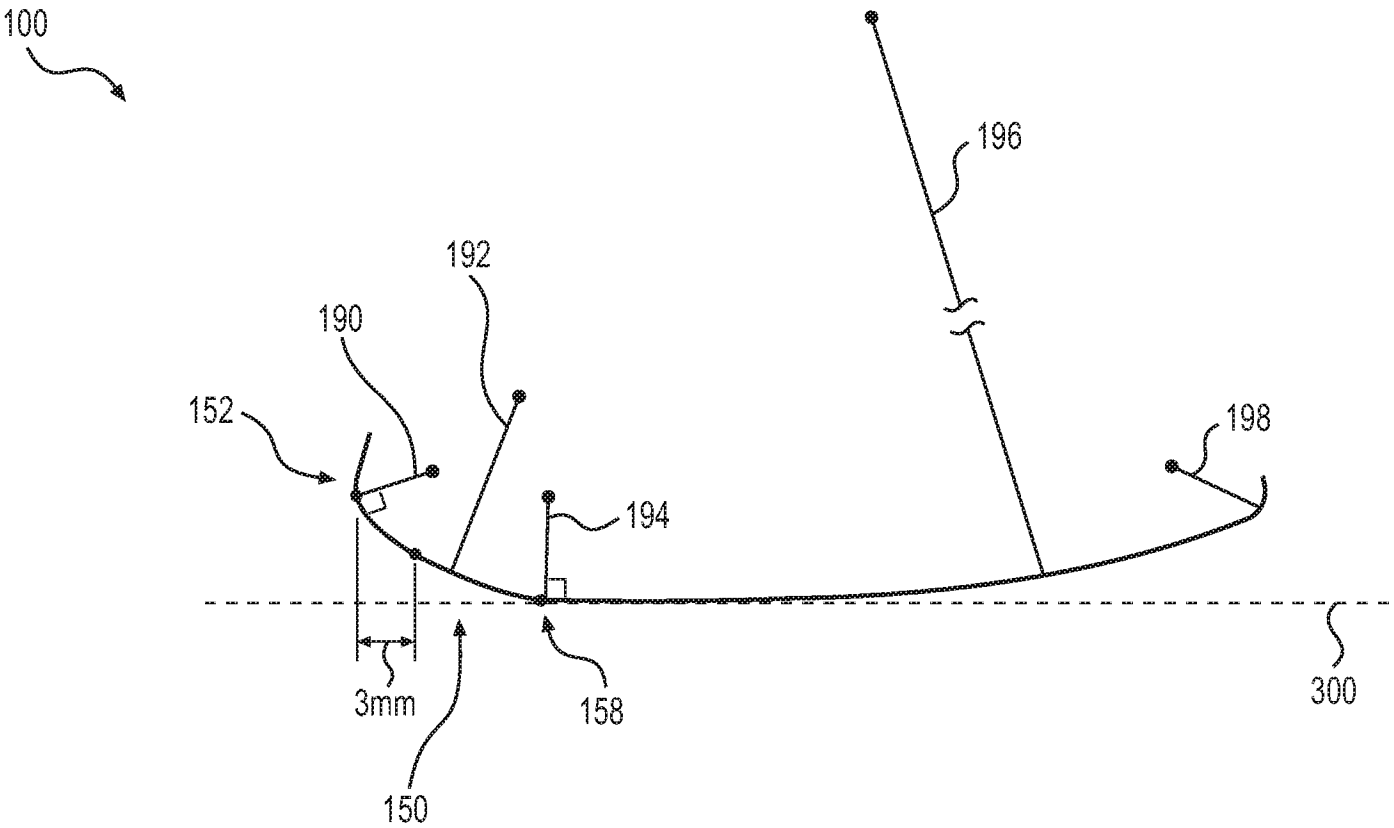
FIG. 5 shows a partial detail of the cross-section view of the golf club head of FIG. 1.

FIG. 5 shows yet further detail of the radius of curvature of the sole portion 150 along the virtual vertical plane IV. The radius of curvature of the sole portion 150 changes in the front-to-rear direction of the club head. The "blend" of the various radii of curvature has perhaps the largest impact on the sole's ability to minimize speed loss due to turf interaction. At a forward location no more than 3 mm from the leading edge 152, the radius of curvature 190 of the sole portion 150, or "R1," may preferably be no greater than 30 mm, more preferably no greater than 20 mm, and even more preferably no greater than 16 mm. Most preferably, the radius of curvature 190 of the sole portion 150 may be between 10 mm and 16 mm. At a more rearward location that is spaced no less than 3 mm rearward of the leading edge, the radius of curvature 192 of the sole portion 150, or "R2," may preferably be no less than 100 mm, more preferably no less than 200 mm, and even more preferably no less than 250 mm. Preferably, the radius of curvature 192 is greater than ten times the radius of curvature 190, more preferably is greater than 15 times the radius of curvature 190, and most preferably is between 18 and 25 times the radius of curvature 190. Preferably, the radius of curvature of the sole portion 150 may decrease rearward relative to the radius of curvature 192 toward an intermediate minimum radius of curvature 194, or "R3" or "Rmin," at a point near the sole contact point 158 and closer to the leading edge 152 than the trailing edge 154. In some embodiments, R3 corresponds with the sole contact point of the sole portion. The radius of curvature of the sole portion 150 may then increase toward the trailing edge 154 to a maximum radius of curvature 196, or "R4," and it may thereafter decrease to a radius of curvature 198, or "R5," near the trailing edge 154. The radius of curvature of the sole portion 150 may thus vary in a central region of the sole portion 150 delimited by a forward end spaced 3 mm rearward of the leading edge 152 and a rearward end spaced 3 mm forward of the trailing edge 154 such that radius of curvature 194<radius of curvature 192<radius of curvature 196.

Returning to FIG. 3, the widths 212, 222, and 232 of the central sole rail 212, toe-side sole rail 222, and heel-side sole rail 232 in the heel-to-toe direction may preferably vary in the front-to-rear direction. The width 212 of the central sole rail 210 in particular may preferably taper in the forward direction. It may preferably taper toward a minimum at a location 214 between the leading 152 and trailing 154 edges of the sole portion 150 so that its maximum width is at a location 216 at the rear of the sole portion. This location 214 of minimum width may preferably be located closer to the leading edge 152 of the sole portion 150 than to the trailing edge 154. More specifically, its distance 218 may preferably be between 5 mm and 15 mm from the leading edge 152 and more preferably between 6 mm and 12 mm from the leading edge. This location 214 may also be located less than 50% of the sole length 156 from the leading edge 152 of the sole portion 150, more preferably between 10% and 25% of the sole length 156 from the leading edge, and even more preferably between 15% and 22% of the sole length 156 from the leading edge. Moreover, the maximum value of the width 212 at the location 216 may preferably be greater than or equal to 7 mm, more preferably greater than or equal to 10 mm, even more preferably between 12 mm and 18 mm, and most preferably equal to or about 15 mm. The minimum value of the width 212 at the location 214 may in turn preferably be between 5 mm and 12 mm, more preferably between 7 mm and 10 mm, and most preferably equal to or about 9 mm.

Figure 6:
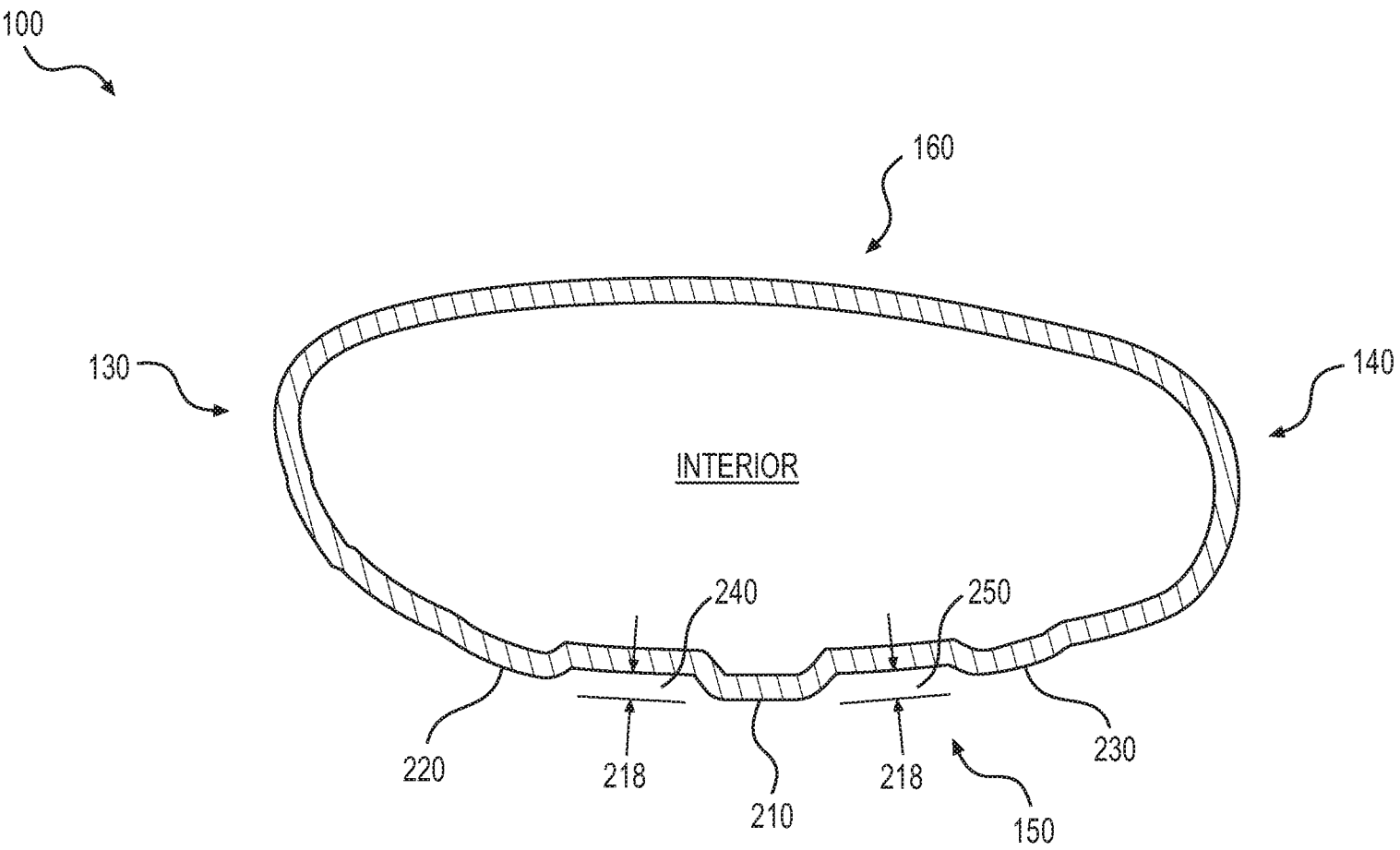
FIG. 6 shows another cross-section view of the golf club head of FIG. 1.

FIG. 6 shows another cross-section of the golf club head 100 taken at the virtual vertical plane VI shown in FIG. 1. As shown in this Figure, each of the sole rails 210, 220, and 230 may be elevated relative to the adjacent portions of the sole portion 150. For example, the portion of the central sole rail 210 closest to the virtual ground plane 300 when in the reference position may extend from the surfaces of the adjacent recesses 240 and 250 by an elevation 218. This elevation 218 may preferably be no less than 3 mm. It may more preferably be between 3 mm and 6 mm. And it may even more preferably be equal to or about 4 mm. This elevation 218 may be created by way of stepped-down portions 260 and 270 (FIG. 3) at the front of the sole portion 150. These stepped-down portions 260 and 270 lead to the recesses 240 and 250, respectively, and they are thus responsible for increasing the clearance and perceived depth of the sole rails 210, 220, and 230. The vertical depth of the stepped-down portions 260 and 270 relative to the front of the sole portion 150 is preferably greater than or equal to 2 mm and more preferably greater than or equal to 3 mm.

Figure 7:
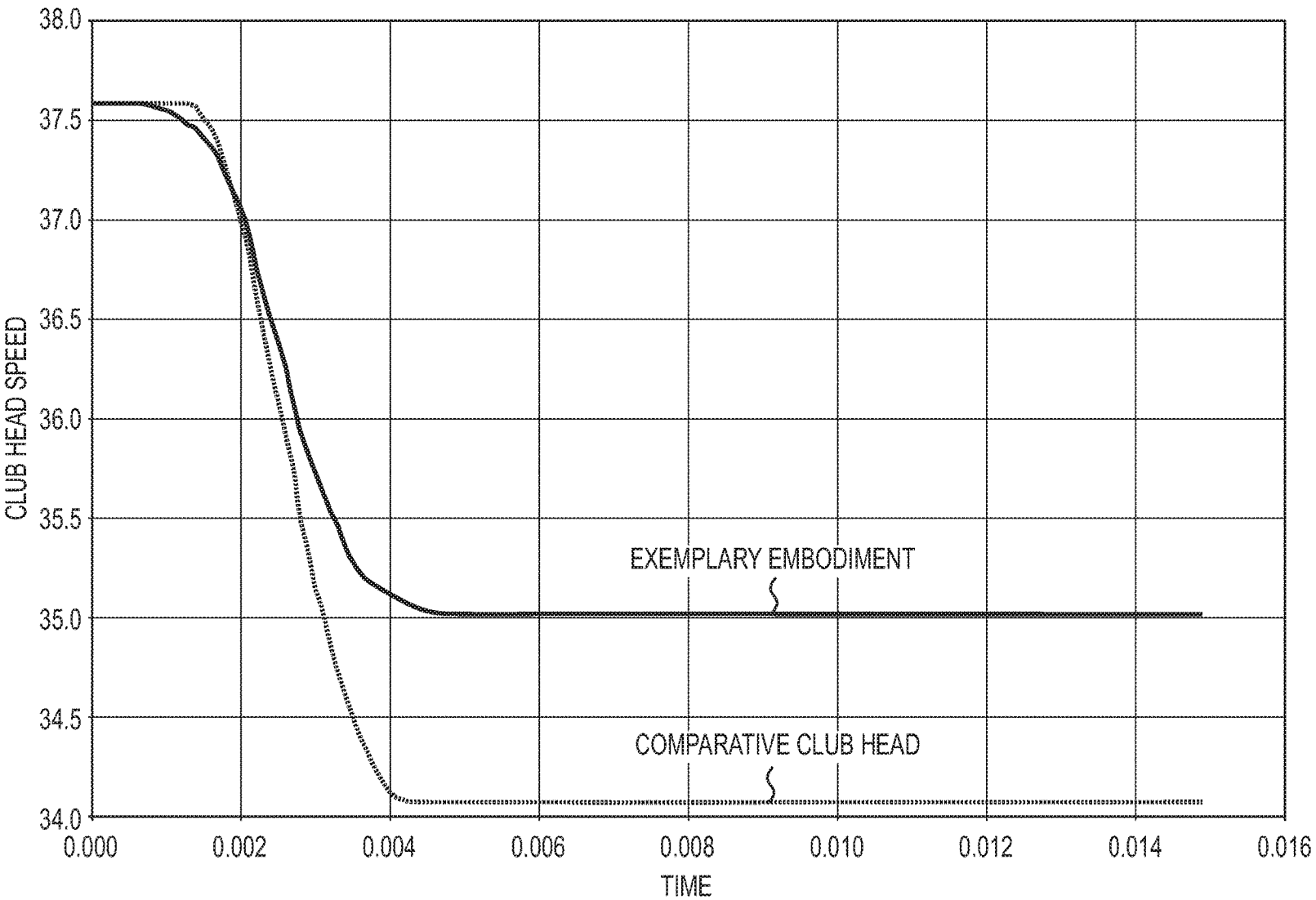
FIG. 7 shows a graph with club head speeds of a golf club head in accordance with one or more exemplary embodiments and a comparative club head.
Figure 8B:
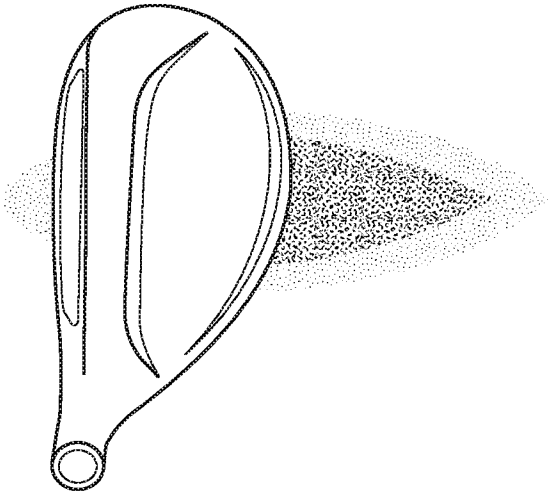
FIGS. 8A and 8B show dynamic turf movement from interaction with the comparative and exemplary golf club heads, respectively.
Figure 8A:
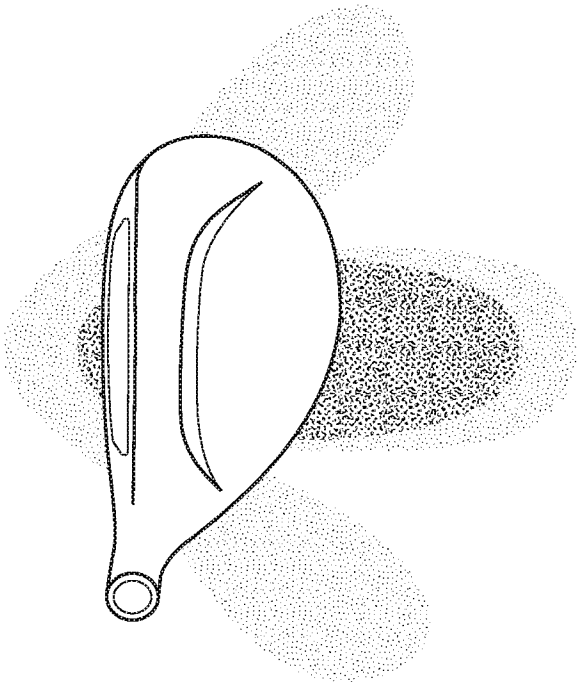

FIG. 7 shows a comparison of the club head speed at impact for an exemplary golf club head in accordance with the present disclosure, e.g., the golf club head 100, and a prior comparative club head, which lacks the sole rails 200. As can be seen, although the head speed is initially the same for the two club heads, interaction with the turf beginning at about 0.002 seconds reduces the speed of the comparative club head substantially more than that of the exemplary club head. FIGS. 8A and 8B in turn show the turf dispersion at impact with the golf ball between the comparative club head and the exemplary club head, respectively. The comparative club head disperses more turf and creates a larger wake along the areas near the toe and heel of the club head than the exemplary club head. The exemplary club head according to the present disclosure thus improves speed retention, leading to a more consistent and predictable distance and trajectory on struck shots.

In the foregoing discussion, the present invention has been described with reference to specific exemplary aspects thereof. However, it will be evident that various modifications and changes may be made to these exemplary aspects without departing from the broader spirit and scope of the invention. Accordingly, the foregoing discussion and the accompanying drawings are to be regarded as merely illustrative of the present invention rather than as limiting its scope in any manner.

What is claimed is:

1. A golf club head that, when oriented in a reference position, comprises:

a striking face;

a top portion; and a sole portion opposite the top portion, the sole portion comprising (i) a leading edge, (ii) a trailing edge, (iii) at least three sole rails each generally elongate in a front-to-rear direction and including a central sole rail, a heel-side sole rail, and a toe-side sole rail, (iv) a sole contact point located on the central sole rail, (v) a first recess formed between the central sole rail and the toe-side sole rail, and (vi) a second recess formed between the central sole rail and the heel-side sole rail;

wherein, in a virtual vertical plane extending in the front-to-rear direction and passing through the sole contact point:

the sole portion includes a sole length Ls measured in the front-to-rear direction from the leading edge to the trailing edge;

the sole contact point is spaced rearwardly from the leading edge by a distance D1 no greater than 0.8*Ls, D1 also being between 5 mm and 15 mm; and the sole portion comprises (i) a plurality of radii of curvature that each extend in the front-to-rear direction and are forward of the sole contact point, a radius of curvature of the plurality of radii of curvature closest to the leading edge being spaced rearward from the leading edge by less than distance D1 and by no more than 3 mm, and (ii) at least one radius of curvature that extends in the front-to-rear direction and is rearward of the sole contact point;

wherein, in the reference position and along the virtual vertical plane, a vertical distance between the sole portion and a virtual ground plane increases forward of the sole contact point from the sole contact point to the leading edge;

wherein the central sole rail extends closer to the leading edge than do the heel-side and toe-side sole rails;

wherein the central sole rail comprises a forward end, a rearward end, and a width in a heel-to-toe direction that varies such that a minimum central sole rail width corresponds with a location intermediate the forward end and the rearward end, the location being closer to the forward end than to the rearward end, and the location being between 10% and 25% of the sole length Ls from the leading edge; and wherein a distance between heel-side and toe-side walls of each of the first and second recesses increases continuously from a forward-most part of the recess to a rearward-most part of the recess.

2. The golf club head of claim 1, further comprising a loft between 14 degrees and 26 degrees.

3. The golf club head of claim 1, wherein the sole length Ls is no less than 35 mm.

4. The golf club head of claim 1, wherein D1 is no greater than 0.5*Ls.

5. The golf club head of claim 4, wherein D1 is no greater than 0.25*Ls.

6. The golf club head of claim 1, wherein:

the striking face further comprises a face center; and the central sole rail is generally aligned with the face center in the heel-to-toe direction.

7. The golf club head of claim 1, wherein, in the virtual vertical plane, the leading edge comprises a height H1 no less than 5 mm.

8. The golf club head of claim 1, wherein the at least central sole rail includes an elevation no less than 3 mm.

9. A golf club head that, when oriented in a reference position, comprises:

a striking face;

a top portion; and a sole portion opposite the top portion, the sole portion comprising (i) a leading edge, (ii) a trailing edge, (iii) three sole rails each generally elongate in a front-to-rear direction and including a central sole rail, a heel-side sole rail, and a toe-side sole rail, (iv) a sole contact point located on the central sole rail, (v) a first recess formed between the first central sole rail and the toe-side sole rail, the first recess having a step-down portion defined in the front-to-rear direction, and (vi) a second recess formed between the central sole rail and the heel-side sole rail;

wherein, in a virtual vertical plane extending in the front-to-rear direction and passing through the sole contact point:

the sole portion includes a sole length Ls measured in the front-to-rear direction from the leading edge to the trailing edge;

the sole contact point is spaced rearwardly from the leading edge by a distance D1 no greater than 0.8*Ls, D1 also being between 5 mm and 15 mm; and the sole portion comprises (i) a plurality of radii of curvature that each extend in the front-to-rear direction and are forward of the sole contact point, a radius of curvature of the plurality of radii of curvature closest to the leading edge being spaced rearward from the leading edge by less than distance D1 and by no more than 3 mm, and (ii) at least one radius of curvature that extends in the front-to-rear direction and is rearward of the sole contact point;

wherein, in the reference position and along the virtual vertical plane, a vertical distance between the sole portion and a virtual ground plane increases forward of the sole contact point from the sole contact point to the leading edge; wherein the central sole rail extends closer to the leading edge than do the heel-side and toe-side sole rails;

wherein the central sole rail comprises a forward end, a rearward end, and a width in a heel-to-toe direction that varies such that a minimum central sole rail width corresponds with a location intermediate the forward end and the rearward end, the location being closer to the forward end than to the rearward end, and the location being between 10% and 25% of the sole length Ls from the leading edge; and wherein a distance between heel-side and toe-side walls of each of the first and second recesses increases continuously from a forward-most part of the recess to a rearward-most part of the recess.

10. The golf club head of claim 9, wherein the step-down portion comprises a depth no less than 2 mm.

11. The golf club head of claim 9, wherein:

the first and second recesses each further comprise a bottom surface and a side surface, which includes the heel-side and toe-side walls and at least partially circumscribes the bottom surface; and the central sole rail is elevated from the bottom surface of each of the first and second recesses by a distance no less than 3 mm.

12. The golf club head of claim 9, further wherein:

the striking face further comprises a face center; and the central sole rail is generally aligned with the face center in a-the heel-to-toe direction.

13. The golf club head of claim 9, wherein, in the virtual vertical plane extending in the front-to-rear direction and passing through the sole contact point, the leading edge comprises a height H1 no less than 5 mm.

14. A golf club head that, when oriented in a reference position, comprises:

a striking face;

a top portion; and a sole portion opposite the top portion, the sole portion comprising (i) a leading edge, (ii) a trailing edge, (iii) at least three sole rails each generally elongate in a front-to-rear direction and including a central sole rail, a heel-side sole rail, and a toe-side sole rail, (iv) a sole contact point located on the central sole rail, (v) a first recess formed between the central sole rail and the toe-side sole rail, and (vi) a second recess formed between the central sole rail and the heel-side sole rail;

wherein, in a virtual vertical plane extending in the front-to-rear direction and passing through the sole contact point:

the leading edge includes a height H1 of no less than 5 mm;

the sole further comprises a first radius of curvature R1 at a first location spaced rearward from the leading edge by no more than 3 mm and a second radius of curvature R2 at a second location rearward of the first location, the second radius of curvature R2 being forward of the sole contact point;

R2 is no less than 10*R1; and

R2 is no less than 100 mm;

wherein, in the virtual vertical plane and relative to an interior of the golf club head, the sole portion is not convex from the leading edge to the trailing edge;

wherein the central sole rail extends closer to the leading edge than do the heel-side and toe-side sole rails;

wherein the central sole rail comprises a forward end, a rearward end, and a width in a heel-to-toe direction that varies such that a minimum central sole rail width corresponds with a location intermediate the forward end and the rearward end, the location being closer to the forward end than to the rearward end, and the location being between 10% and 25% of the sole length Ls from the leading edge; and wherein a distance between heel-side and toe-side walls of each of the first and second recesses increases continuously from a forward-most part of the recess to a rearward-most part of the recess.

15. The golf club head of claim 14, wherein R1 is no greater than 30 mm.

16. The golf club head of claim 14, wherein:

the striking face further comprises a face center; and the central sole rail is generally aligned with the face center in a-the heel-to-toe direction.

* * * * *